United States Patent [19]

May

[11] Patent Number: 4,854,782

[45] Date of Patent: Aug. 8, 1989

[54] APPARATUS FOR LIFTING STRUCTURES

[75] Inventor: Donald R. May, Independence, Mo.

[73] Assignee: Sandra L. May, Independence, Mo.

[21] Appl. No.: 125,188

[22] Filed: Nov. 25, 1987

[51] Int. Cl.[4] ..... E02D 27/48

[52] U.S. Cl. ..... 405/230; 405/232

[58] Field of Search ..... 405/229, 230, 231, 232; 254/29 R

[56] References Cited

U.S. PATENT DOCUMENTS

| | | | |
|---|---|---|---|
| 3,685,301 | 8/1972 | Heacox | 405/230 |
| 3,796,055 | 3/1974 | Mahony | 405/230 |
| 3,902,326 | 9/1975 | Langenbach Jr. | 405/230 |
| 4,070,867 | 6/1978 | Cassidy | 405/231 |
| 4,634,319 | 1/1987 | May | 405/230 |
| 4,678,373 | 7/1987 | Langenbach | 405/230 |

OTHER PUBLICATIONS

Undated Literature Articles Entitled: "The Magnum Pier" and The Slab Jack System.

*Primary Examiner*—David H. Corbin

*Attorney, Agent, or Firm*—Hovey, Williams, Timmons & Collins

[57] ABSTRACT

An apparatus for lifting structure is provided which includes a pier and a shoe attached to the base of a structure. A sleeve, which acts as a means to guide the shoe and support the shoe on the pier, is placed on the pier and is adapted to mate with the shoe. In order to lift the structure, a lift bracket is attached to the shoe and a hydraulic ram or jack is inserted between the top of the sleeve and the bottom of the lift bracket. After the ram is extended to raise the structure to the desired level, pins are inserted through the shoe and shims inserted between the laterally extending plates of the sleeve and the pins driven through the shoe in order to permanently support the structure. After insertion of these permanent supports, the hydraulic ram and lift bracket may be removed and reused at a different site.

8 Claims, 2 Drawing Sheets

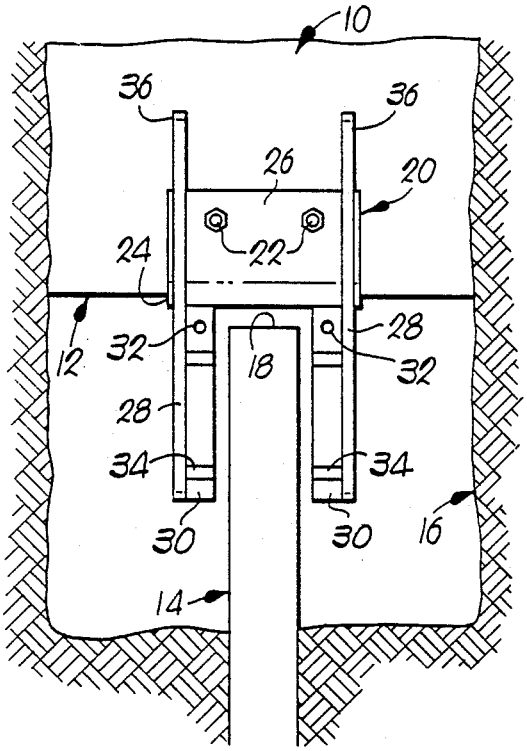
Fig.1.
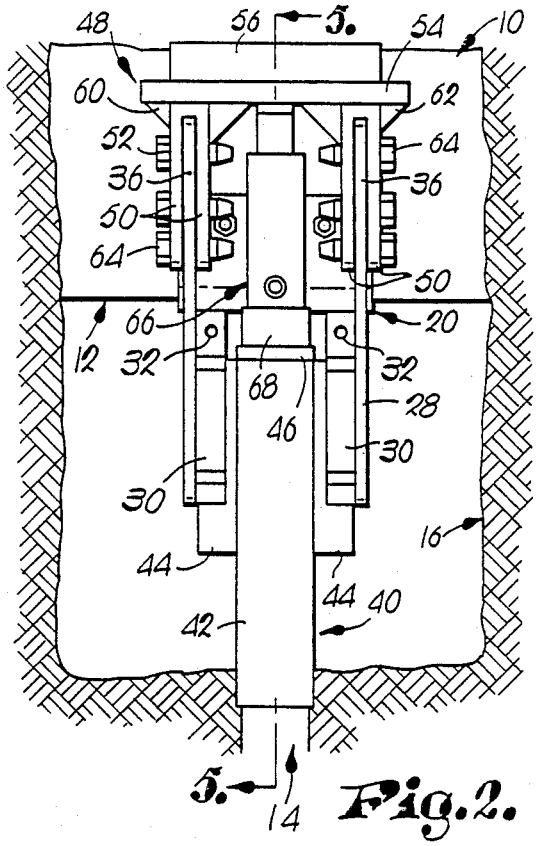
Fig.2.
Fig.3.
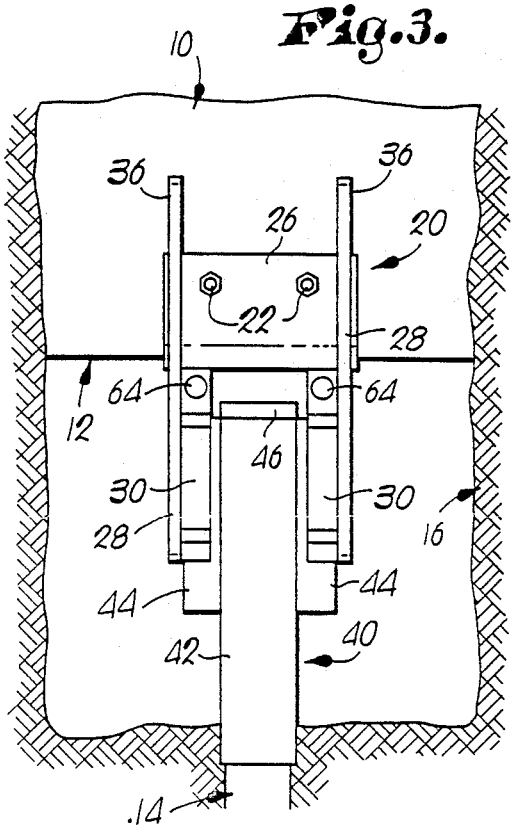
Fig.4.
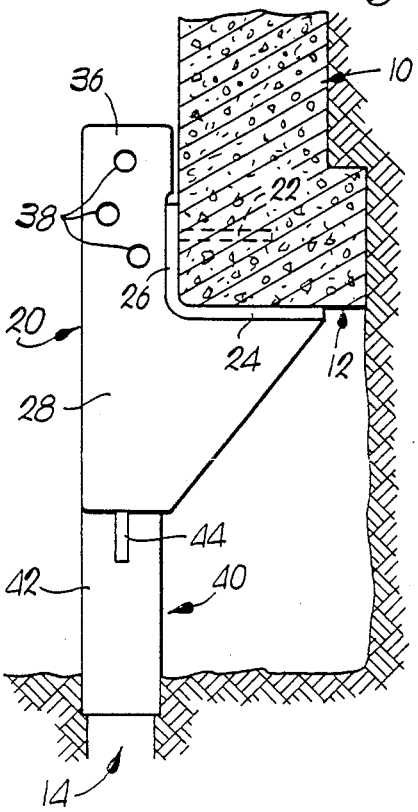

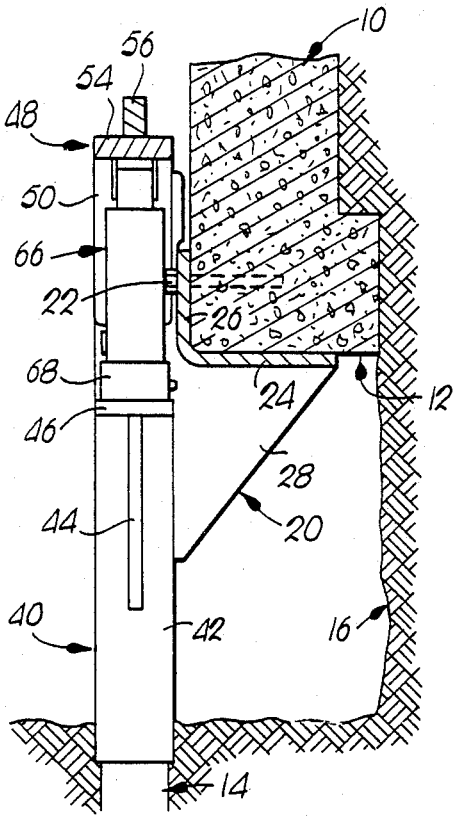
Fig.5.
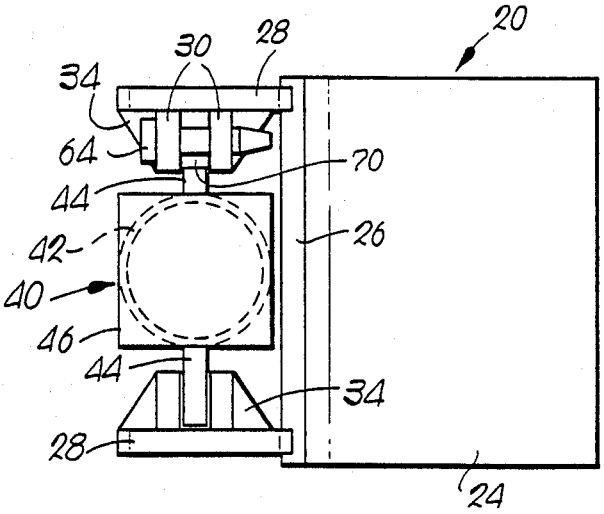
Fig.6.
Fig.7.
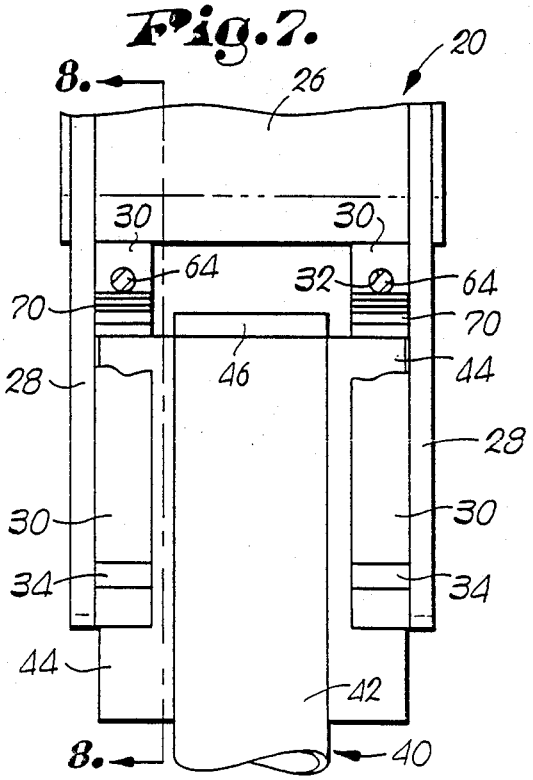
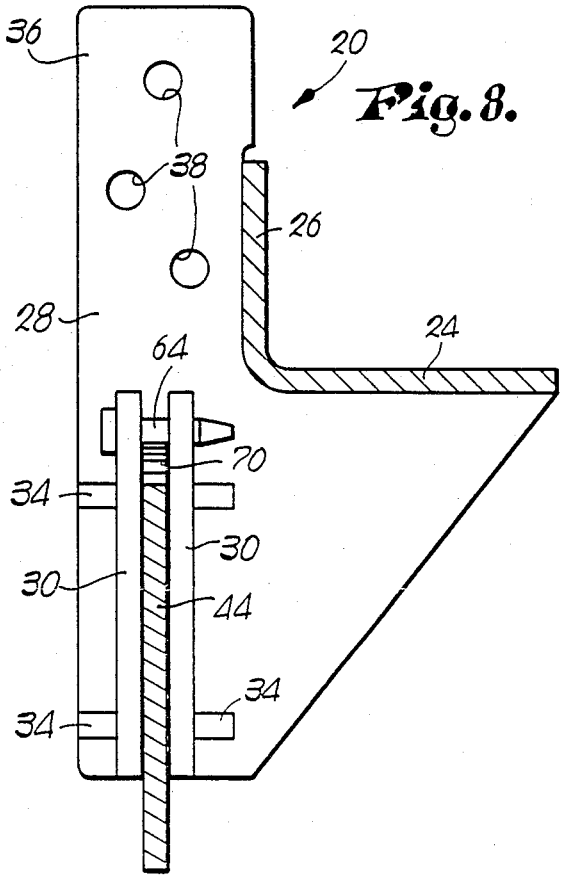
Fig.8.

APPARATUS FOR LIFTING STRUCTURES

FIELD OF THE INVENTION

This invention relates to an apparatus designed to lift and support structures, particularly buildings and the like which have settled from their original desired position and need to be righted or levelled whereby to cure structural defects which may have occurred as a result of the settlement of the structure. The apparatus is placed at desired points around the perimeter of the base of the structure and permits the structure to be lifted to a desired position and then to be supported in such position by a plurality of piers which have been driven beneath the structure whereby the load of the structure is carried on top of a plurality of individually driven piers.

BACKGROUND OF THE INVENTION

Structures are occasionally constructed on soil or other surfaces which have insufficient load bearing strength to support the structure. The foundations of these structures inevitably settle in an uneven manner which causes the structure to lean or the foundation to crack. The structure must then be lifted and supported to its original, desired position in order to be preserved and made useful.

Preferably, the structure may be righted without excessive excavation or disturbance to the adjacent property. The present invention utilizes the same method of driving individual piers beneath a structure, the piers being driven to bedrock or strata of measured design strength, as has been disclosed in my U.S. Pat. No. 4,634,319. However, the present apparatus is a lightweight, economical means of support particularly suited to residential or light commercial buildings. In particular, the present apparatus leaves a minimum of material in the ground to support the structure after the building has been raised, thus reducing the cost of materials in any operation. Inasmuch as multiple piers and support apparatus are normally required to ultimately support a structure, the present apparatus provides a significant cost reduction to the user. In addition, the present invention provides improved lateral support during lifting of the structure through the mating of a shoe mounted to the base of the structure and a sleeve supported on the pier.

SUMMARY OF THE INVENTION

The invention consists of an apparatus for lifting and supporting structures which includes a pier, a sleeve mounted on the pier, a shoe connected to the base of a structure and mating with the sleeve, a lift bracket connected to the shoe and temporary lift means inserted between the sleeve and the lift bracket. The shoe is mated to the sleeve to allow substantially vertical movement of the shoe as the building is lifted. A hydraulic ram or jack inserted between the sleeve and the lift bracket serves as a temporary lifting means which, when extended, raises the structure to the desired position. Once in position, the building is permanently supported by securing the shoe to the sleeve. Thereafter, the ram and the lift bracket may be removed for use at a different site. A series of piers and lifting apparatus are usually required to support a single structure.

BRIEF DESCRIPTION OF THE DRAWINGS

FIG. 1 is a front elevational view showing a structure to be lifted, an excavation surrounding the base of the structure, a pier and a shoe attached to the base of the structure.

FIG. 2 is a front elevational view similar to FIG. 1 showing the addition of a sleeve mounted on the pier, a lift bracket mounted on the shoe and temporary lift means inserted between the sleeve and shoe.

FIG. 3 is a front elevational view similar to FIG. 1 showing the lift bracket and temporary lift means removed and the structure and apparatus in the final position.

FIG. 4 is a side elevational view showing the mounting of the shoe to the base of the structure.

FIG. 5 is a sectional view taken along line 5—5 of FIG. 2 showing the placement of the temporary lifting means between the sleeve and the lift bracket.

FIG. 6 is a top plan view of the shoe and sleeve.

FIG. 7 is a fragmentary enlarged front elevational view of the shoe and sleeve with portions broken away to show the presence of the shims and pins.

FIG. 8 is a sectional view along line 8—8 of FIG. 7 showing the shoe supported on the sleeve by the pins and shims.

DESCRIPTION OF THE PREFERRED EMBODIMENT

The apparatus of the present invention is intended for lifting and supporting a structure 10 which has settled and needs to be lifted and permanently supported in a fixed and desired position. Typically such structures 10 will be residential and smaller commercial structures as other apparatus such as that disclosed in U.S. Pat. No. 4,634,319 would ordinarily be employed for larger commercial and industrial buildings.

Typically, a building structure 10 to be supported will be provided with a footing or base 12. An area proximate to the perimeter of the structure will then be excavated to gain access to the base. Thereafter, a pier 14 is driven through the soil 16 until it contacts bedrock or other load bearing strata of sufficient premeasured design strength. Piers 14 are driven as set forth in my U.S. Pat. No. 4,634,319, and ordinarily a plurality of vertically positioned piers 14 will be driven adjacent to the base 12 in order to support the structure 10. Ordinarily, each pier 14 will be composed of individual sections driven successively until the desired load bearing strata is reached.

Once the pier 14 has been driven to its maximum depth and the remaining piers driven as desired, there are a multitude of piers positioned around the structure 10. The top of the piers 14 will then be cut off proximate to the base 12 of the structure, leaving the upper surface 18 of the pier 14 slightly lower than the base 12 of the structure 10 as shown in FIG. 1.

A shoe 20 is then attached to the base 12 of the structure 10 by a pair of anchor bolts 22 as shown in FIGS. 1 and 4. The shoe 20 is provided with a horizontal seat 24 and a vertical wall 26. A pair of vertical, spaced apart supports 28 carry the seat 24 and wall 26. The wall 26 is attached to the side of the base 12 and the seat 24 is located in contact with the underside of the base 12. A pair of wings 30 extend laterally and inwardly from each support 28. Wings 30 are spaced apart so that guide means may pass therebetween. Holes 32 are located at the upper end of the wings 30. The wings 30 are typically formed by welding ridges to supports 28 and are reinforced by gussets 34 welded to the wings 30 and the supports 28. At the upper end of supports 28 are ears 36 which are provided with three mounting holes 38 as shown in FIG. 4.

Sleeve 40 is mounted over pier 14 as shown in FIGS. 3 and 6. The sleeve 40 includes a cylinder 42 having laterally extending plates 44 on opposite sides thereof. The plates 44 extend approximately parallel to the vertical portion of the base 12 of the structure 10. The sleeve 40 is designed to mate with the shoe 20 and plates 44 serve as a guide means for the shoe 20 as the structure 10 is raised. The plates 44 on the sleeve 40 thus fit within and mate with the wings 30 of the shoe 20. The sleeve 40 is additionally provided with a cover 46 so that the sleeve 40 rests on top of the pier 14 which is securely fastened to the cylinder 42. The supports 28 further constrain any lateral movement of the shoe 20 inasmuch as they bracket and are located adjacent to plates 44.

After the placement of sleeve 40 on pier 14, a lift bracket 48 is positioned on the ears 36 of shoe 20 as shown in FIG. 2. The lift bracket 48 is provided with pairs of spaced apart legs 50 which fit over ears 36. The legs 50 are provided with mounting holes 52 located and sized corresponding to the mounting holes 38 on the ears 36 of the shoe 20. The legs 50 are connected together by header 54 constructed of steel plate. A ridge 56 is welded on top of the header 54 to provide additional structural rigidity to the lift bracket 48. A set of gusset plates 60, 62 provide additional support for header 54. A series of hardened steel tapered pins 64 driven into aligned mounting holes 38 and 52 join shoe 20 to lift bracket 48.

In operation, a hydraulic ram or jack 66 is inserted on a block 68 or spacer placed on the cover 46 of sleeve 40 for each pier 14 on which the structure 10 is to be raised. As the ram 66 is extended, it pushes up on header 54 of lift bracket 48. Inasmuch as the lift bracket 48 is directly connected to the shoe 20 by tapered pins 64, the seat 24 of each shoe 20 which is in contact with the base 12 begins to exert a lifting force on the base 12 of the structure 10, as shown in FIGS. 2 and 6. This lifting force causes the lift bracket 48, shoe 20 and structure 10 to move upward in a vertical direction, supported by rams 66 and pier 14. The shoe 12 is guided upward along the sleeve 40 by the wings 30 on either side of each plate 44. The ram 66 is extended until the structure 10 is raised to the desired height. Inasmuch as a series of piers 14 are normally driven around the structure, the use of hydraulic rams 66 permits the structure to be raised simultaneously on the piers 14 when the ram 66 are interconnected to a single hydraulic pump.

Once the structure 10 has been raised to a desired level, hardened steel tapered pin 64 are driven into hole 32 and a series of shims 70 of appropriate size inserted between the top of plates 44. Thereafter, ram 66 and block 68 are removed from on top of sleeve 40 and pins 64 removed from mounting holes 38 and 52 to permit the removal of bracket 48 from shoe 20. As shown in FIGS. 3, 7 and 8, the structure 10 is thereafter supported by the shoe 20, which in turn is supported by the plates 44 of sleeve 40 by virtue of the pin 64 inserted through holes 32 of wing 40 and shims 70 inserted between the pins 64 and plates 44. The structure is thus supported by a shoe 20, supported on a sleeve 40 on each driven pier 14.

I claim:

1. Apparatus for lifting and supporting a building structure having a base comprising:

a vertically positioned pier driven in the ground adjacent the building structure and having an upper end proximal to the base of the building structure;

a sleeve fitted over the upper end of the pier, said sleeve including a pair of opposed, vertically oriented plates extending laterally from said sleeve;

a shoe attached to the base of the structure, said shoe including means mating with said plates for inhibiting lateral movement of said shoe relative to said sleeve during vertical movement of said shoe along said sleeve;

temporary lifting means between the sleeve and the shoe; and permanent supporting means including means connected to said mating means for abutting said plate to support the structure in its final, desired position.

2. Apparatus as set forth in claim 1 wherein said mating means includes a pair of spaced apart wings extending inwardly from said shoe toward said sleeve, said wings adapted to receive one of said plates therebetween.

3. Apparatus as set forth in claim 2, there being a plurality of said pairs of spaced apart wings, each pair of wings being oriented for cooperative association with a respective plate to resist relative lateral movement between said sleeve and said shoe during vertical movement of said shoe along said sleeve.

4. Apparatus as set forth in claim 2, said permanent support means including abutment means connected to said pair of wings for supporting said shoe on said plate.

5. Apparatus as set forth in claim 4, said abutment means including a horizontally oriented pin extending through said wings.

6. Apparatus as set forth in claim 5, said permanent supporting means including shim means located between said wings and intermediate said pin and said plate.

7. Apparatus as set forth in claim 1, including a lift bracket demountably connected to said shoe, said lift bracket being oriented to receive said temporary lifting means between said sleeve and said lift bracket.

8. Apparatus as set forth in claim 7, wherein said shoe includes a horizontal seat positioned beneath the base of the structure, a vertical wall, a pair of spaced apart generally vertical supports carrying the seat and the wall, and a pair of spaced apart wings extending inwardly from said supports and oriented for receiving one of said plates between each pair of wings to enable relative vertical movement between said sleeve and said shoe, said vertical supports including means for demountably connecting said lift bracket to said shoe.

* * * * *